United States Patent [19]

Elfarr

[11] 4,243,102

[45] Jan. 6, 1981

[54] METHOD AND APPARATUS FOR FLOWING FLUID FROM A PLURALITY OF INTERCONNECTED WELLS

[76] Inventor: Johnnie A. Elfarr, P.O. Box 901, Palestine, Tex. 75801

[21] Appl. No.: 7,365

[22] Filed: Jan. 29, 1979

[51] Int. Cl.[3] ..... E21B 43/00; F04F 1/02

[52] U.S. Cl. ..... 166/314; 166/68; 166/105.5; 417/54; 417/118

[58] Field of Search ..... 166/68, 314, 105, 105.5; 417/54, 55, 118, 138, 139

[56] References Cited

U.S. PATENT DOCUMENTS

| | | | |
|---|---|---|---|
| 1,754,945 | 4/1930 | Haskell | 417/138 |
| 3,005,413 | 10/1961 | Coberly | 166/68 |
| 3,106,170 | 10/1963 | Gray | 417/138 |
| 3,260,308 | 7/1966 | Cryer | 166/68 |
| 3,782,468 | 1/1974 | Kuwada | 166/267 |
| 3,797,968 | 3/1974 | Elfarr | 417/138 |
| 3,833,060 | 9/1974 | Craggs et al. | 166/68 |
| 3,873,238 | 3/1975 | Elfarr | 417/54 |
| 4,025,235 | 5/1977 | Newbrough | 417/54 |

OTHER PUBLICATIONS

"Simple Chamber Pump Lifts Hot, Steam Flood Wells", Nov. 1977, World Oil.

*Primary Examiner*—James A. Leppink
*Attorney, Agent, or Firm*—Arnold, White & Durkee

[57] ABSTRACT

Method and apparatus for flowing fluid from a plurality of interconnected wells wherein a pressurized lift gas is injected into a well thereby actuating a pumping unit located in the well. Upon actuation, at least a portion of the partially expended lift gas is injected into an adjacent well whereby this adjacent well is pre-pressurized prior to it being fully pressurized by lift gas for actuation. This pre-pressurizing decreases the fully pressurized gas needed to actuate the second well.

7 Claims, 1 Drawing Figure

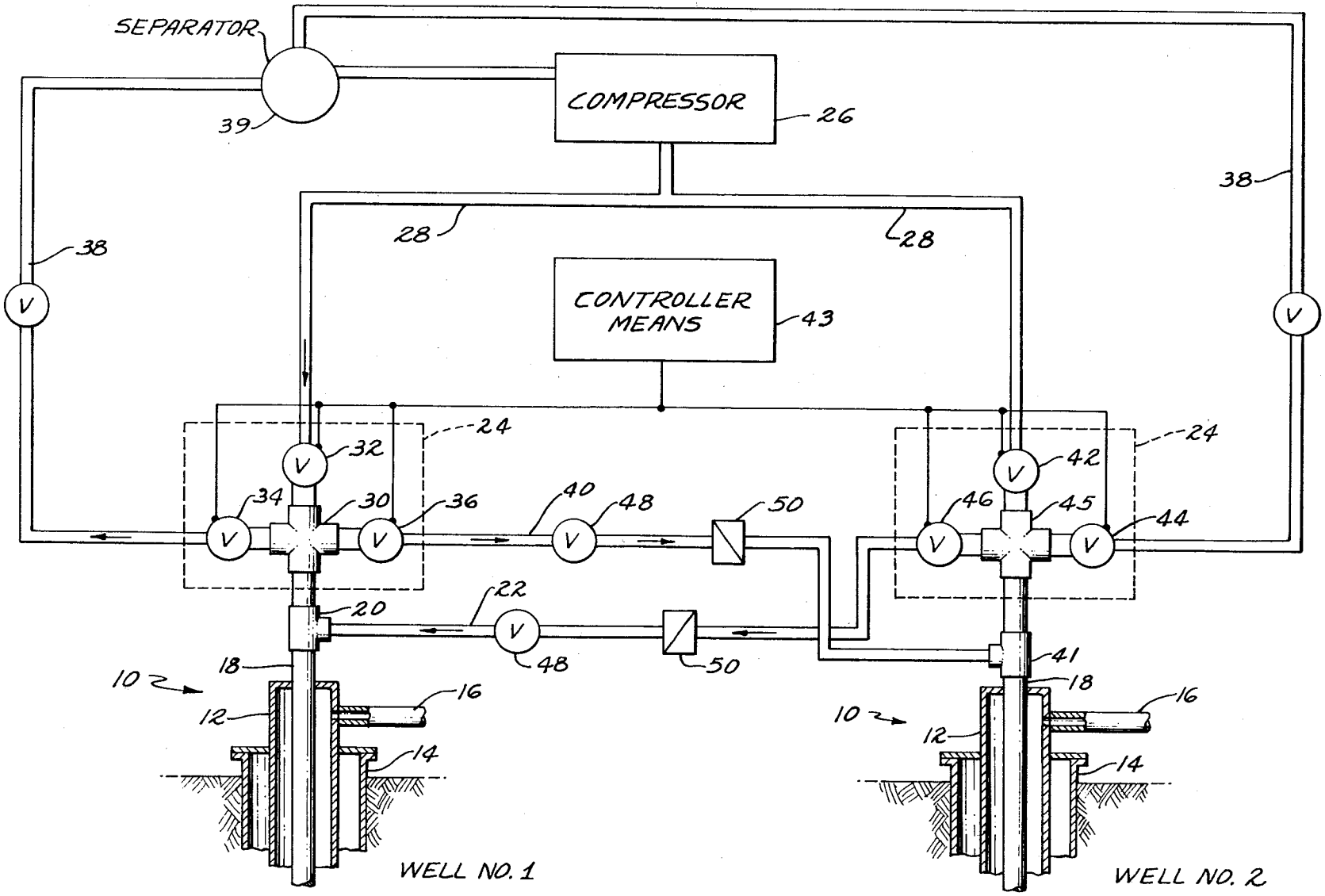
COMPRESSOR
CONTROLLER MEANS
SEPARATOR
WELL NO. 1
WELL NO. 2

METHOD AND APPARATUS FOR FLOWING FLUID FROM A PLURALITY OF INTERCONNECTED WELLS

BACKGROUND OF THE INVENTION

1. Field of the Invention

The present invention relates generally to the field of improved processes and systems for recovering fluid such as oil from earth formations. More particularly, this invention relates to a process and system to selectively inject pressurized gas into a plurality of interconnected wells for displacement of the liquid to be produced and to re-inject at least a portion of this gas into an adjacent well.

2. Description of the Prior Art

While the invention will be explained for purposes of simplicity with regard to its application to production of oil from oil bearing earth formations having little or no formation pressure, it is considered understood that the invention may be utilized effectively for displacement of other fluids that may or may not be located within earth formations. The present invention will be discussed in its application solely for the production of oil from oil bearing earth formations for purposes of simplicity and to facilitate ready understanding of the invention.

Various processes and systems have been developed in the past for recovering oil from subterranean formations which have insufficient formation pressure to cause the oil to flow. Such recovery methods in the past have taken the form of mechanically energized pumps and pneumatic displacement pumps. Recently, certain pneumatic displacement pumps have become available which utilize compressed air, steam, or natural gas to energize the pump. Oftentimes these pumps are designed such that the displacement or lift gas is not commingled with the fluid being produced, such as allowing the gas to bubble through the production fluid, but rather the lift gas is maintained in a separate system or chamber with the pump being actuated by simply allowing the lift gas to expand and thereby actuate the pump. Typical pumps are disclosed in U.S. Pat. Nos. 3,106,170; 3,797,968 and 3,873,238.

It has also been found that during operation of such pneumatic pumps, the lift gas which actuates the pump is not completely decompressed after pump actuation but rather remains at an elevated pressure capable of preforming additional work. However, in the past this gas has simply been recycled directly back to a gas source such as a conventional gas compressor without any attempt to take advantage of this remaining energy. Since it is common that this expended lift gas be collected in a central collection system and communicated to a central compressor, substantial portions of the energy contained in the compressed gas is dissipated while moving through this system. Therefore, substantial amounts of energy are lost through the failure of previously known systems to utilize at least a portion of the energy contained in the partially expended lift gas.

In recent years much emphasis has been placed upon the recovery of oil which heretofore has been uneconomical to produce. Typical of this previously uneconomical production is the highly viscous oil which often requires injection of steam or water in order to reduce the viscosity of the crude oil and thereby allow it to migrate toward a production well. Such operations are quite expensive and therefore it is necessary to make extensive efforts to maximize the efficiency of all artificial lift systems.

A feature of the present invention pertains to increasing overall efficiency of an artificial lift system utilized for producing closely spaced and interconnected wells.

Another feature of the present invention resides in its maximum utilization of available compressor capacity within an existing artificial lift system. A further feature of the present system involves the reduction in overall costs for lifting oil from oil bearing formations having insufficient pressure to cause the production fluid to flow.

It is also an important feature of the present invention to provide a novel gas injection and control system enabling increased cyclic injection and re-injection of pressurized lift gas without creating a need for additional compressor capacity.

The present invention is advantageous over the art in that the same is economical to construct, efficiently maximizes the amount of oil which may be produced with a limited amount of compressor capacity, and is easily controlled by a central controlling means.

The present invention is summarized in that an apparatus for utilizing pressurized gas for flowing liquid from a plurality of interconnected well includes an injection conduit connecting each of the wells to a central gas compression source, a lift control assembly for each of the wells which is connected to the injection conduit. A low pressure exhaust conduit is connected with each lift control assembly and communicates low pressure exhaust gas back to the gas source. A high pressure exhaust conduit is also connected to each lift control assembly and communicates high pressure exhaust gas capable of performing additional work to an adjacent well. This adjacent well is therefore pre-pressurized by the use of the high pressure exhaust lift gas from the prior well. Actuation of the pump in the adjacent well is then accomplished by increasing the pressure in the adjacent well an amount substantially less than what would have been required to actuate the pump without utilizing the high pressure exhaust.

Other features and advantages of the present invention will become apparent from the following description of the preferred embodiment when taken in conjunction with the accompanying drawing.

BRIEF DESCRIPTION OF THE DRAWINGS

FIG. 1 is a generally schematic view of one preferred embodiment of the artificial lift system of this invention.

DETAILED DESCRIPTION OF THE PREFERRED EMBODIMENTS

Referring to FIG. 1, there is disclosed a plurality of well bores drilled into the earth from the surface to an oil bearing formation, each well bore having a lining or casing typically of metal pipe. Located at the lower extremity of each of the well bores is a pumping unit (not shown) which is actuated by pressurized gas commonly referred to as lift gas supplied to the well bore through conduit typically forming a central lift system. The pumping unit may be of such construction as to utilize a pressurized lift gas to cause the pump to operate without requiring the lift gas to be commingled to a large extent with the liquid being produced. A pumping unit which applicant has found to be satisfactory is described in applicant's prior patent, U.S. Pat. No. 3,797,968. However, it should be understood that the specific construction of the pumping unit does not form a part of the present invention.

At the upper extremity of each well bore is deposed a wellhead illustrated generally at 10, consisting principally of an outer conduit 12 secured to casing 14 with collection conduit 16 attached to conduit 12 for communicating liquid which is pumped by the pumping unit upwardly in conduit 12 to a central collection point in the oil field.

Located within outer conduit 12 is inner conduit 18 which may be supported at its upper extremity by attachment to outer conduit 12 through the use of a conventional tubing hanger structure. Inner conduit 18 is designed to communicate the presurrized lift gas from the upper extremity of the well bore to the pumping unit as more fully described in applicant's prior patent, U.S. Pat. No. 3,797,968.

Attached to the upper extremity of inner conduit 18 is a conventional tee connection member 20 having a high pressure exhaust line 22 connected to one of its ports, the function of high pressure exhaust line 22 being more fully explained subsequently. The remaining or upper port of connection member 20 is attached to a lift control assembly shown generally at 24.

As also seen in FIG. 1, a lift gas source 26 is also shown which supplies lift gas at a pressure sufficient to actuate each of the pumping units located within the various well bores. As can be understood, this lift gas source may take the form of a conventional gas compressor but it is contemplated that a previously existing high pressure natural gas well may also be utilized to provide lift gas at sufficiently high pressures.

A network of injection conduits 28 is disclosed in FIG. 1 which connects gas source or compressor 26 with each of the well bores from which liquid is to be produced. Each of the lift control assemblies 24 is interposed between a connecting branch of injection conduits 28 and the upper port of the tee connection member 20.

Each lift control assembly 24 includes a central connector 30 having four ports. Connected to one port of connector 30 is tee member 20 attached to the inner conduit 18. Attached to a second port of connector 30 is injection control valve 32 with low pressure exhaust valve 34 and high pressure exhaust valve 36 attached to the two remaining ports of connector 30. Although the term "valve" has been used, it is to be understood that such a term is meant to include any type of flow restrictor which may be used to control flow of a fluid.

As shown in FIG. 1, injection control valve 32 is connected to injection conduit 28 thereby allowing pressurized lift gas provided by compressor 26 to pass through connectors 30 and 20 into inner conduit 18 when injection valve 32 is in an open position and valves 34 and 36 are in a closed position.

Connected to low pressure exhaust valve 34 is low pressure exhaust conduit 38. Low pressure exhaust conduit 38 is shown in FIG. 1 as being connected back to compressor 26 through separator 39 utilized to remove liquid or other contaminants from the expended lift gas prior to entering compressor 26. Thus, when low pressure exhaust valve 34 is in its open position with valves 32 and 36 in their closed positions, expended lift gas is allowed to flow from the inner conduit 18, through connectors 20 and 30 and into low pressure exhaust conduit 38 thereby returning to compressor 26 for repressurization and reuse. However, it can be understood that such low pressure exhaust gas may be simply vented into the atmosphere if the appropriate operating conditions are present.

High pressure exhaust conduit 40 in FIG. 1 is connected to high pressure exhaust valve 36 and is capable of communicates expended lift gas to an adjacent well by means of a second tee connection member 41 comparable to member 20 of Well No. 1 previously described.

Also disclosed in FIG. 1 is controller means 43 connected through electrical or pneumatic lines to valves 32, 34 and 36. Controller means 43 may be an electrically or pneumatically actuated timer or other means for selectively operating the opening and closing of valves through signals. Such a controller means is at least partially described in prior patent U.S. Pat. No. 3,106,170. As can be appreciated valve 32, 34 and 36 may be the type of valve which is easily automatically actuated by electrical or pneumatic signals such as solenoid valve although other automatically actuated valves may be employed with equal success.

Controller means 43 is employed to selectively and automatically actuate valves 32, 34 and 36 to achieve cyclic actuation of the pumping units as will be more fully explained as the operation of the invention is discussed.

FIG. 1 also shows a second well bore, Well No. 2, having a similar wellhead 10 and lift control assembly 24 as previously described. It will be noted that the high pressure exhaust conduit 40 is connected to tee connection member 41 thereby enabling, through sequential operation of valves 32, 34 and 36, a selected portion of the expended lift gas utilized by Well No. 1 to be communicated to the inner conduit of Well No. 2. Shut off valve 48 and check valve 50 are connected into line 40 in order to allow the operator to isolate a selected well during repair operations and insure that gas only flows in the desired direction.

OPERATION

It is contemplated that through the operation of the above described structure, it is possible to utilize pressurized gas which has been partially reduced in pressure to facilitate actuation of a pumping unit located in an adjacent well.

In order to better understand the various steps employed in a complete cycle of the present invention, operation of the various components related to Well No. 1 and Well No. 2 will be discussed. However, it will be understood that the present system and process can be easily adapted for more than two wells. For convenience, the injection control valve associated with Well No. 2 has been designated 42 with low pressure exhaust valve 44 and high pressure exhaust valve 46 also being associated with Well No. 2.

For convenience, the cycle by which Well No. 1 is supplied with pressurized gas will be discussed first. In an initial or starting phase, low pressure exhaust valves 34, 44 are in an open position with injection control valves 32, 42 and high pressure valves 36, 46 being closed. This position allows whatever lift gas remains in Well No. 1 after completion of the prior cycle to be exhausted through low pressure exhaust valve 34 into conduit 38 and returned to gas source 26. A similar status is present for Well No. 2 whereby low pressure lift gas is allowed to be recirculated back to gas source 26 through low pressure exhaust valve 44.

In order to provide Well No. 1 with fully pressurized lift gas, controller 43, by a predetermined schedule, closes low pressure exhaust valve 34 and opens injection control valve 32, high pressure exhaust valves 36, 46 and injection 42 remaining closed with low pressure exhaust valve 44 remaining opened. As a result of injection control valve 32 being opened, fully pressurized lift gas from conduit 28 is communicated through injection control valve 32 and connector 30 into inner conduit 18 thereby actuating the pumping unit located within Well No. 1. As a result of such actuation, the pumping unit propels liquid toward the upper extremity of conduit 12 and out collection conduit 16. At the end of the actual pumping phase for Well No. 1, i.e., all liquid to be produced has been pumped from Well No. 1 or the pumping unit has pumped for its predetermined amount of time, controller 43 alters the various valve positions to initiate the high pressure exhaust phase of the present cycle.

To initiate the high pressure exhaust phase, controller 43 closes injection control valve 32 and low pressure exhaust valve 44 and opens high pressure exhaust valve 36, while injection control valve 42 and high pressure exhaust valve 46 remaining closed. As a result of high pressure exhaust valve 36 being open, lift gas used to actuate the pump of Well No. 1 but still having a pressure in excess of a predetermined amount may be communicated to an adjacent well. Although this partially expended lift gas may be a pressure lower than the originally provided lift gas from conduit 28, it is of sufficient pressure to assist lifting operations in an adjoining well by pre-pressurizing the adjacent well in order to decrease the energy needed from the pressure source for actuation of the second pumping unit. Therefore, partially expended lift gas is communicated through high pressure exhaust conduit 40 to tee connection 45 of an adjacent well such as Well No. 2 in FIG. 1. By communicating this partially expended lift gas to Well No. 2 prior to injection of fully pressurized gas from conduit 28, Well No. 2 is pre-pressurized to such an extent that less fully pressurized gas is needed by Well No. 2 to actuate its pump than would be needed if the inner conduit of Well No. 2 has been fully vented into conduit 38 just prior to injection of fully pressurized gas.

After at least some of the lift gas from Well No. 1 has been communicated by high pressure exhaust conduit 40 to Well No. 2, the low pressure exhaust phase of the present cycle for Well No. 1 is initiated. This phase is initiated by control means 43 closing high pressure exhaust valve 36 with injection control valves 32, 42, high pressure exhaust valve 46 and low pressure exhaust valve 44 remaining closed. Low pressure exhaust valve 34 is then opened thereby enabling lift gas having a pressure less than a predetermined amount to flow through low pressure exhaust conduit 38 to gas source 26 for repressurization and reuse. It is noted that the entire expended lift gas resulting from the injection phase of Well No. 1 is not communicated to an adjacent well in order to maximize the pre-pressurization gas available for lifting purposes without diluting or lowering the average pressure available for lifting purposes in the adjacent well.

After completion of the low pressure exhaust phase, the injection phase for Well No. 2 is initiated by controller 43 by opening injection control valve 42 with injection valve 32, high pressure exhaust valves 36, 46 and low pressure exhaust valve 44 remaining closed and low pressure exhaust valve 34 remaining opened. As a result of opening injection valve 42, fully pressurized lift gas is communicated from conduit 28 through connecter 41 to the inner conduit of Well No. 2 thereby actuating its pumping unit. Such actuation results in the liquid to be produced being pumped from Well No. 2 into a collection conduit or flow line.

After a predetermined amount of production fluid has been pumped or a predetermined pumping period has elapsed, Well No. 2 is changed into its high pressure exhaust phase by controller 43. Controller 43 closes injection control valve 42 and low pressure exhaust valve 34 and opens high pressure exhaust valve 46, with injection valves 32, high pressure exhaust valve 36 and low pressure exhaust valve 44 remaining closed. As a result of high pressure exhaust valve 46 being opened, partially expended lift gas having a pressure in excess of a predetermined amount is communicated through conduit 22 to tee connector 20 of Well No. 1 thereby providing lift gas of sufficient pressure to pre-pressurize the pumping unit of Well No. 1. Such pre-pressurizing boosts the existing lift pressure within Well No. 1 thereby enabling actuation of the pumping unit in Well No. 1 with less fully pressurized lift gas from conduit 28.

As can be understood, after pre-pressuring lift gas has been communicated through high pressure exhaust valve 46 to Well No. 1, controller 43 initiates the low pressure exhaust phase for Well No. 2 by closing high pressure exhaust valve 46 and opening low pressure exhaust valve 44. Again, the low pressure exhaust lift gas having a pressure less than a predetermined amount is communicated through conduit 38 to gas source 26 for repressurization and reuse.

At the conclusion of the low pressure exhaust phase of Well No. 2, the above described cycle is repeated whereby injection of Well No. 1 is accomplished by controller 43 opening injection valve 32 with low pressure exhaust valve 34 and high pressure exhaust valve 36 being closed. However, since inner conduit 18 has been pre-pressurized by the exhaust from the high pressure exhaust phase of Well No. 2, the existing pressure within inner conduit 18 is substantially higher than it would have been if all expended lift gas had been simply recycled directly to gas source 26.

As can be appreciated, the above steps enable the use of a portion of the injection gas which has already been used by one well to increase the starting or initial pressure existing within conduit 18 of an adjacent well thereby decreasing the amount of pressurized gas and energy required to actuate the pumping unit of the adjacent well.

As will be noted, high pressure exhaust conduit 22 which communicates high pressure exhaust from Well No. 2 may be connected to any adjacent well which may not necessarily be the well from which Well No. 2 has received high pressure exhaust. In other words, it is contemplated that Well No. 2 may have conduit 22 connected to another well not shown with such well having its high pressure exhaust conduit connected to Well No. 1 thereby enabling such well to exhaust its high pressure exhaust gas into Well No. 1. If such a multiple well configuration is utilized, it may be necessary to utilize a common controller for the three wells to actuate all injection, high pressure and low pressure valves in proper sequence.

Further modifications and alternative embodiments of the apparatus and method of this invention will be apparent to those skilled in the art in view of this description. Accordingly this description is to be construed as illustrative only and for the purpose of teaching those skilled in the art the manner of carrying out the invention. It is to be understood that the forms of the invention herein shown and described are to be taken as the presently preferred embodiments. Various changes may be made in the shape, size and arrangement of parts. For example, equivalent elements or materials may be substituted for those illustrated and described herein, parts may be reversed, and certain features of the invention may be utilized independently of the use of other features, all as would be apparent to one skilled in the art after the benefit of this description of the invention.

I claim:

1. An apparatus for utilizing pressurized gas provided by a gas source for flowing liquid from a plurality of interconnected wells, said apparatus comprising:

an injection conduit connecting said gas source to each of said wells;

a lift control assembly for each one of said plurality of wells, said assembly interposed between a well and the injection conduit, said assembly adapted for selectively introducing pressurized gas from said gas source into the respective well and for selectively communicating exhaust gas from said connected well;

a low pressure exhaust conduit connecting each of said lift control assemblies to said gas source for selectively communicating exhaust gas having a pressure less than a predetermined amount; and a high pressure exhaust conduit for each one of said lift control assemblies, said high pressure exhaust conduit connected between said connected well and the lift control assembly of an adjacent well, said high pressure exhaust conduit communicating exhaust gas having a pressure in excess of a predetermined amount from said connected well to said adjacent control assembly.

2. The apparatus as recited in claim 1 wherein said lift control assembly includes:

an injection control valve for controlling flow of pressurized gas from said injection conduit;

a low pressure exhaust valve for controlling flow of gas from said assembly to said low pressure conduit; and a high pressure exhaust valve for controlling flow of gas from said assembly to said high pressure exhaust conduit.

3. The apparatus as recited in claim 2, wherein said lift control assembly includes controller means for selectively and automatically actuating said control valve, low pressure exhaust valve and high pressure exhaust valve to achieve cyclic actuation of said apparatus.

4. A method for utilizing pressurized lift gas provided by a gas source for flowing liquid from a plurality of interconnected wells, each one of said wells having a gas actuated pumping unit located within said wells, said method comprising the steps of:

causing pressurized lift gas to enter a first well from said gas source;

actuating a pumping unit located within said well for flowing liquid from the well into a collection conduit;

communicating lift gas having a pressure in excess of a predetermined amount from said well to an adjacent well;

injecting said lift gas having a pressure in excess of a predetermined amount into said adjacent well;

exhausting lift gas having a pressure less than a predetermined amount from said first well;

causing pressurized lift gas to enter said adjacent well from said gas source;

actuating a pumping unit located within said adjacent well for flowing liquid from said adjacent well into a collection conduit;

communicating lift gas having a pressure in excess of a predetermined amount from said adjacent well to one of said plurality of wells; and exhausting lift gas having a pressure less than a predetermined amount from said adjacent well.

5. The method of claim 4 wherein the lift gas having a pressure less than a predetermined amount is communicated from said first well to said gas source for repressurization.

6. The method of claim 4, wherein the steps of claim 4 occur repetitively to induce cyclic displacement pumping action in each of said pumping units.

7. The method of claim 4 wherein the lift gas having a pressure in excess of a predetermined amount is communicated from said adjacent well to said first well.

* * * * *